United States Patent [19]

Phillips, Jr.

[11] 4,148,153

[45] Apr. 10, 1979

[54] TRUNDLE LOOP AND METHOD OF DETACHABLY CONNECTING SAME TO A HOOP

[76] Inventor: James T. Phillips, Jr., 4336 W. 59th Pl., Los Angeles, Calif. 90043

[21] Appl. No.: 881,250

[22] Filed: Feb. 27, 1978

[51] Int. Cl.[2] ..... A63H 33/02

[52] U.S. Cl. ..... 46/220

[58] Field of Search ..... 46/220

[56] References Cited

U.S. PATENT DOCUMENTS

| | | | |
|---|---|---|---|
| 1,906,480 | 5/1933 | Metz | 46/220 |
| 1,924,978 | 8/1933 | Bullis | 46/220 X |
| 2,149,960 | 3/1939 | Heath | 46/220 |

FOREIGN PATENT DOCUMENTS

| | | | |
|---|---|---|---|
| 995898 | 8/1976 | Canada | 46/220 |

*Primary Examiner*—Louis G. Mancene

*Assistant Examiner*—Robert F. Cutting

*Attorney, Agent, or Firm*—Victor C. Muller

[57] ABSTRACT

Hoop propelling trundle of the hoop capturing type characterized by a resilient circular split ring, preferably in the form of a helix of somewhat less than a single convolution, with ends normally spaced apart a distance less than the cross sectional diameter of the propelled hoop and which may be sprung apart in the direction normal to the plane of the ring to provide an enlarged opening between its ends to permit the hoop to pass therethrough for detachably connecting the hoop and ring. The ends of the ring are disposed at its forward or capturing end and both ends engage the hoop when rolling in engagement therewith during arresting of the forward motion of the hoop. The ring is also circular in cross section to provide the same rolling contact therewith in various positions of tilt of the plane of the hoop relative to a horizontal surface.

7 Claims, 7 Drawing Figures

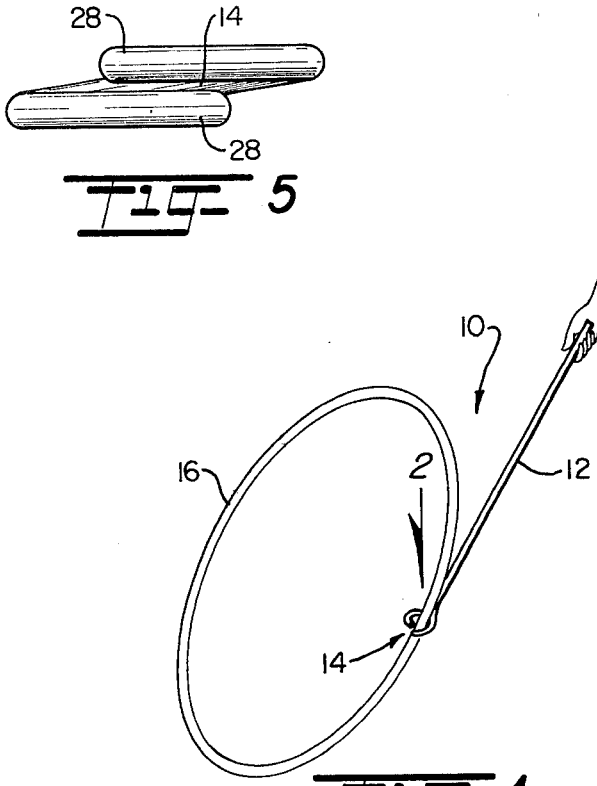
FIG. 1
FIG. 5
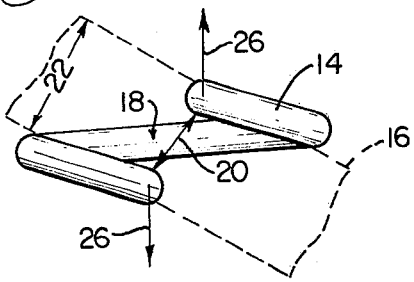
FIG. 4
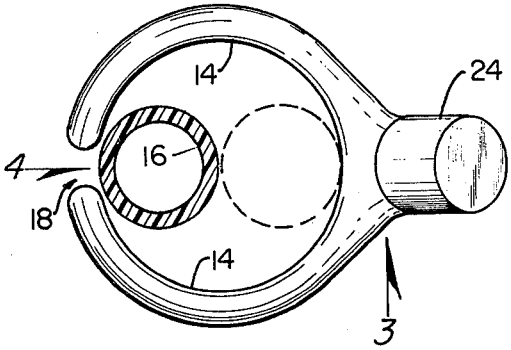
FIG. 2
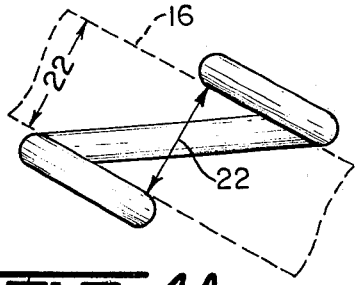
FIG. 4A
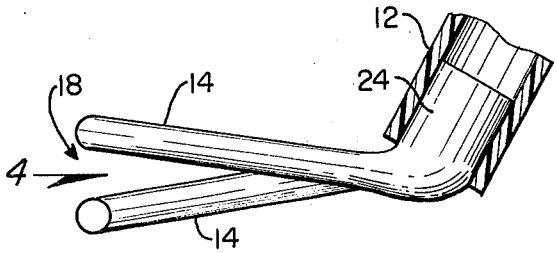
FIG. 3
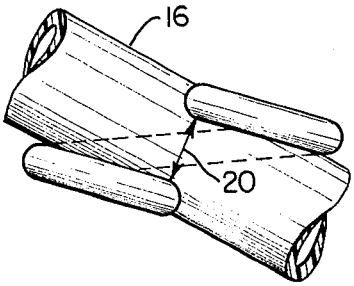
FIG. 4B

TRUNDLE LOOP AND METHOD OF DETACHABLY CONNECTING SAME TO A HOOP

BACKGROUND OF THE INVENTION

The art of hoop rolling for sport, amusement, exercise or other purpose is of old and uncertain origin as alluded to in U.S. Pat. No. 3,827,180 to Phillips, several of the myriad of other patents which have issued thereon being cited therein as exemplary of the art to which the present invention pertains.

Propelling trundles are of two general types, one being that in which the hoop is not captured, as exemplified by the U.S. Pat. to Rendon, No. 2,984,937, and the other that in which the hoop is captured, as exemplified by the Phillips patent above, U.S. Pat. No. 1,356,023 to Cyr and U.S. Pat. No. 2,970,403 to Land. While the capturing type has advantages when used with a truly circular hoop which normally may roll at uniform velocity, it becomes of further advantage when used with a non-circular hoop which rolls at non-uniform velocity as set forth in U.S. Pat. No. 3,935,668 to Phillips.

The art also reveals that a hoop may be a continuous ring without ends (U.S. Pat. No. 3,827,180) or formed in segments (U.S. Pat. No. 3,935,668). In the former, the trundle loop must be constructed in some manner to provide an opening therein to attach same to the hoop. In the latter, the hoop may be opened at a joint therein and an endless propelling ring threaded onto an end thereof. Thus, the use of a circular endless capturing ring would be feasible for use with this patent by disjointing one of the segments which, as will be apparent, is cumbersome. It logically follows that the ideal manner of attaching the trundle loop to the hoop resides in the loop construction, whether or not the hoop is endless. The prior art, of course, discloses various trundle loops which serve such purpose.

SUMMARY OF THE INVENTION

From the standpoint of overall operability, which includes forward propelling of a hoop, arresting its motion, guiding it, and controlling it at various angles of tilt to the surface on which it rolls, an endless circular loop of circular cross section well satisfies these criteria. An endless loop cannot, however, be detachably connected to an endless hoop and requires a cumbersome operation to attach it to a hoop having separable ends. This premise broadly suggests a closeable opening of some sort in the loop or ring, of which there are, no doubt, many solutions.

Experiments have revealed that the ends of a split helix (one convolution of a conventional coil spring) may be spread further apart by opposed axial forces more readily than by opposed circumferential forces applied at its ends. As is well known, axial forces on a coil spring produce pure torsional forces on all cross sections, producing pure shear forces therebetween. Circumferential forces, however, act on the ends of a curved beam which deflects with combined forces of compression and tension, generally referred to as flexure. While the comparative stress analysis between flexure and stress has not been determined it has been observed that it is easier to stretch a coil spring than to open a single split convolution to a larger diameter. The present invention employs this observation by providing a hoop capturing loop in the form of a helix, preferably of somewhat less than one convolution and to the ends of which opposite axial forces are applied to produce torsional forces at its cross sections, thus stretching the ends axially apart in the manner that the convolutions would stretch apart in a conventional coil spring. Experiments have also revealed that the ends of the helix may overlap somewhat and provide a hoop entrance locus which may be enlarged to permit the hoop to pass therethrough. This construction, while possible by winding, cutting, cementing and allied processes is cumbersome and expensive and not readily amenable to economical molding processes and equipment. The preferred invention is thus further characterized by the helix ends being spaced apart, with a gap therebetween, which simplifies the construction of a die in which it may be injection moulded, employing a plastic material.

A principal object of the invention is to provide a hoop propelling trundle with a loop of the capturing type constructed and operable in accordance with the foregoing.

Another object is to provide a trundle propelling loop in the form of a helix, preferably of slightly less than one convolution.

Another object is to provide a trundle loop of constant radius of curvature, and without internal discontinuities which might disturb the smooth rolling contact of a hoop therewith.

Another object is to provide a trundle loop which may be economically manufactured by injection moulding process.

A further object is to provide a novel method of effecting detachable connection between the loop and hoop.

Still further objects, advantages, and salient features will become more apparent from the detailed description to follow, the appended claims, and the accompanying drawing to now be briefly described.

BRIEF DESCRIPTION OF THE DRAWNG

FIG. 1 depicts the subject of the invention in use;

FIG. 2 is a full scale plan of the propelling loop as viewed in the direction of arrow 2, FIG. 1;

FIG. 3 is a side elevation as viewed in the direction of arrow 3, FIG. 2, also illustrating in section the lower end of a trundle handle;

FIGS. 4, 4A and 4B are end elevations, as viewed in the direction of arrow 4, FIG. 2, illustrating steps in effecting connection of the loop to a hoop, the attaching shank shown in FIGS. 2 and 3 being omitted to simplify the drawing; and FIG. 5 illustrates a stage of development of the invention illustrated in the previous FIGS.

DETAILED DESCRIPTION OF PREFERRED EMBODIMENTS

Referring now to the drawing in detail, and first to FIG. 1, trundle 10 comprises a plastic or other light weight tubular handle 12 and a capturing trundle loop 14 for controlling rolling motion of hoop 16, which may be rolled along the ground by an operator, as illustrated.

Referring to FIGS. 2 and 3, loop 14 is formed as a resilient helix of somewhat less than one convolution to provide a gap or space 18 between its ends. The normal distance 20 between such ends is best illustrated in FIG. 4 which, as will be apparent, is less than the diameter 22 of hoop 16.

In the attachment of loop 14 to hoop 16 (shown in dotted lines in FIG. 4 to better illustrate the loop) the hoop is disposed across gap 18 at an angle, as illustrated, the reason for which will be subsequently described. The hoop and loop are then forced relatively in the direction perpendicular to the plane of the drawing. FIG. 4A illustrates an intermediate relative position in which former gap 20 has now been increased to gap 22, the diameter of the hoop. When the diameter of the hoop passes beyond this maximum gap, the ends of the ring cam the hoop into the captured position within the ring, as shown in FIG. 4B, and the ends of the ring return to their normal gap 20. The hoop and ring are then relatively rotated to the position of FIG. 2 which is also the operating position of FIG. 1.

The reason for employing a helical split ring, rather than a planar split ring, will now be described. If a planar ring were employed and the axis of the hoop forced toward the axis of the ring the gap could increase only by increasing the ring diameter, which, as previously referred to, would require bending forces applied to opposite ends of a curved beam. With the helical construction no beam bending moment is involved. On the contrary, the effective components of force 26,26 as shown in FIG. 4, which are applied by camming action to the ends of the ring are in axial directions, rather than in the direction of the ring circumference. The single helical coil is thus subjected to pure torsion in the same manner as experienced by a tension coil spring when elongated by an axial force which spreads its coils further apart. As also previously referred to, the spreading of the coils may be effected with considerably less force than by increasing their diameter with a circumferential force. As should also now be apparent, the axial force may best be applied by disposing the hoop and loop in the angular relationship, as illustrated.

As will also be apparent, the circular cross section of the ring provides a parting surface at the center of its section in the form of a helical or twisted surface thus permitting relatively simple moulding die construction. The shank 24, while at some angle to the twisted plane of the ring may be formed in one side of the mould, still permitting removal of the integral injection moulded device therefrom. Attachment of shank 24 to handle 12 may be effected by cement, heat weld, or any other manner known in the art.

As previously referred to, a stage in the development of the invention described, above, comprised a helical ring with overlapping ends, 28,28, FIG. 5. These may be slightly spaced or in abutting relation, the circular converging sides of adjacent ends forming a wedge shape mouth or locus into which the circular section of the hoop may be disposed, as in FIG. 4, and which form a wedge for spreading the ends further apart. This has the advantage that the ring is completely closed during use, like the solid endless ring referred to as the ideal. Its construction as a mouldable product is, however, difficult which led to the helical ring with gapped ends. It is to be understood, accordingly, that such construction is also within the purview of the invention, and would be a satisfactory construction were it not for its difficulty of construction as an inexpensive injection mouldable product. The assembly of such construction is similar to that described but differs in that instead of initially abutting the hoop on the tips of the loop ends, the hoop abuts the overlap centrally between the ends and cams the ends apart in opposite axial directions and without enlarging its diameter which action, of course, is the same as the gapped ring construction.

What I claim is:

1. In a hoop propelling trundle having a handle and a loop at one end thereof of the type adapted to detachably capture a hoop therein, whereby the hoop may be propelled or arrested in its motion, said loop comprising:

(a) a resilient circular loop in the form of a helix having axially spaced free ends, (b) said ends normally being also spaced circumferentially to prevent the hoop from passing therebetween, (c) said ends adapted to be sprung axially further apart to provide a space disposed axially between the ends to permit passing the hoop therebetween and into the loop for capturing same therein, (d) the construction and arrangement being such that the hoop and loop may be assembled by abutting the hoop and loop ends at an angular relationship such that a hoop cross sectional diameter is substantially aligned with the direction between ends of the loop, and applying a force directed radially inwardly of the loop for cammingly spreading the ends in opposite axial directions of the loop and without increasing its diameter, permitting the hoop to pass therebetween, (e) said handle being connected to the loop at the rear end thereof between said axially spaced free ends.

2. A trundle in accordance with claim 1 wherein said ends are spaced apart in a circumferential direction.

3. A trundle in accordance with claim 1 wherein said ends overlap each other in a circumferential direction.

4. A trundle in accordance with claim 2 including a shank disposed at the rear end of the loop, diametrically opposite its ends, and extending angularly relative to the plane of the loop, adapted to be secured to an end of a trundle handle, the loop and shank being integrally formed by injection moulding.

5. A method of attaching a trundle to a circular cross sectional hoop, the trundle having a resilient circular loop at one end thereof in the form of a helix with axially spaced free ends disposed at its forward end and of a diameter to loosely encircle the hoop, the ends adapted to be sprung axially further apart to permit the hoop to pass therebetween and into the loop for capturing same therein, comprising the steps of:

(a) abutting the hoop and loop ends at an angular relationship such that a hoop cross sectional diameter is substantially aligned with the direction between ends of the loop, and (b) applying a force directed radially inwardly of the loop for cammingly spreading the ends in opposite axial directions of the loop and without increasing its diameter, permitting the hoop to pass therebetween.

6. A method in accordance with claim 5 wherein said ends are spaced apart in a circumferential direction.

7. A method in accordance with claim 5 wherein said ends overlap each other in a circumferential direction.

* * * * *